United States Patent [19]

Carpenter et al.

[11] 4,438,794

[45] Mar. 27, 1984

[54] BARK TOOL AND CONNECTION

[76] Inventors: Aaron R. Carpenter, Rte. One, Box 238, Chatom, Ala. 36518; Robert R. Bagby, Rte. Two, Box 504-M, Pell City, Ala. 35125

[21] Appl. No.: 207,477

[22] Filed: Nov. 14, 1980

Related U.S. Application Data

[63] Continuation-in-part of Ser. No. 56,319, Jul. 23, 1979, abandoned.

[51] Int. Cl.[3] ..... B27L 1/00

[52] U.S. Cl. ..... 144/208 E; 144/340

[58] Field of Search ..... 144/208 R, 208 E, 311, 144/340; 83/698

[56] References Cited

U.S. PATENT DOCUMENTS 2,786,499 3/1957 Brundell et al. ..... 144/208 E 3,973,607 8/1976 Jonsson ..... 144/208 E

FOREIGN PATENT DOCUMENTS 233214 4/1969 U.S.S.R. ..... 144/208 E

*Primary Examiner*—W. D. Bray

*Attorney, Agent, or Firm*—Isaac P. Espy

[57] ABSTRACT

The disclosure relates to an improved bark tool for the removal of tree bark from logs in the lumber and paper-making industries, wherein a novel structural tool and connection are disclosed.

1 Claim, 6 Drawing Figures

BARK TOOL AND CONNECTION

STATUS OF ORIGINAL APPLICATION

This is a continuation-in-part of a parent application, Ser. No. 056,319 filed July 23, 1979 now abandoned.

BRIEF BACKGROUND AND SUMMARY OF THE INVENTION

Industries which cut lumber from logs or chips the logs for papermaking customarily remove the bark prior to other processes. Trees which are dragged along the ground after felling accumulate dirt and sand in the tree bark; this abrasive foreign material is particularly abusive to saw blades and chipping knives. It is therefore standard in most operations to remove the bark containing the gritty material prior to further operations.

One well known means of removing the bark is by rotating bark tools around the advancing log, applying great force to the tool tip as it and where it touches the log. This action tends to destroy the underlying cambium layer and the bark easily falls away. Good examples of such machines are found in patents to Brundell, et al., U.S. Pat. Nos. 2,857,945 and 2,903,028.

In order to accomodate logs of different sizes, and irregularities in the log, the bark tool tips initially are clustered together and then forced apart as the advancing log meets the rotating crescent shaped tools. A tensioning device similar to huge rubber bands by leverage forces the tips towards the center of the circular shaped machine through which the log travels.

Great forces are continually impinging on the bark tools, and almost daily maintenance is normally required. The tips and the supported end of the tool are easily broken or bent.

Heretofore, the bark tools have been crescent shaped at each end; at the tip, and also at the supported end which is attached to a shaft which transmits the torque created by the rubber tensioning device. An analysis of the moment induced in the tool indicates that the moment linearly increases from the tip to the support, but the moment resisting capacity decreases from about midway of the tool down to the support. For example, FIG. 9 of U.S. Pat. No. 2,857,945 and FIG. 19 of U.S. Pat. No. 2,903,028, and FIG. 5 of U.S. Pat. No. b 2,788,034.

The present invention discloses a novel physical arrangement whereby the tool itself, and its connection to the shaft, are designed to provide structural capacity consonant with stress requirements.

Structural capacity in resisting moment induced stresses is illustrated by the formula $$\sigma=(M/S) \quad (1)$$

where $\sigma$ is stress, M is the moment and S is the section modulus, which for rectangular sections is determined by the formula $$S=(bd^2/6) \quad (2)$$

where b is the thickness of the member transverse to the plane of bending and d is the depth of the member in the plane of bending. Thus if moment increases linearly, stress may be kept constant by increasing the member thickness or depth, or both. My invention increases the depth of the tool from the tip end to the connecting end such that stresses in the tool are relatively constant throughout the tool length. Thus the structural shape governs its moment resisting capacity. The tip end used in my invention is commonly used in the art and has means to debark logs.

DETAILED DESCRIPTION AND PREFERRED EMBODIMENT OF THE INVENTION

Figure 1:
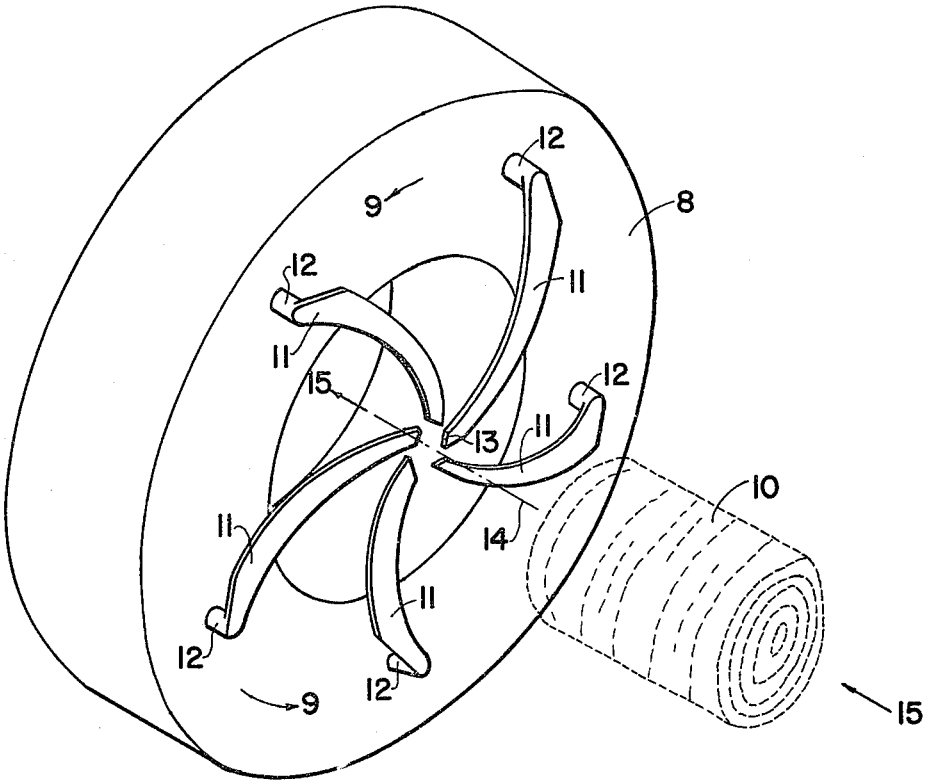
FIG. 1 is an isometric perspective of the central portion of a barking machine.

FIG. 1 is an isometric perspective of the central portion of a barking machine, showing only enough details to explain the purpose and to describe the invention. The rotor 8 rotates as shown by directional arrows 9 within a housing which is not shown. The log 10 to be barked, advances to the barking machine on guides and rollers which are not shown. The bark tools 11 rotate upon shafts 12 which are torqued within the rotor so as to continually keep pressure of the bark tool tips 13 toward the rotor axis centerline 14.

As the log approaches as shown by directional arrows 15, the forward end of the log is forced against and rotates the bark tools away from the rotor axis until they ride the top of the log. The pressure of the bark tool tips loosens the bark which falls away.

Figure 2:
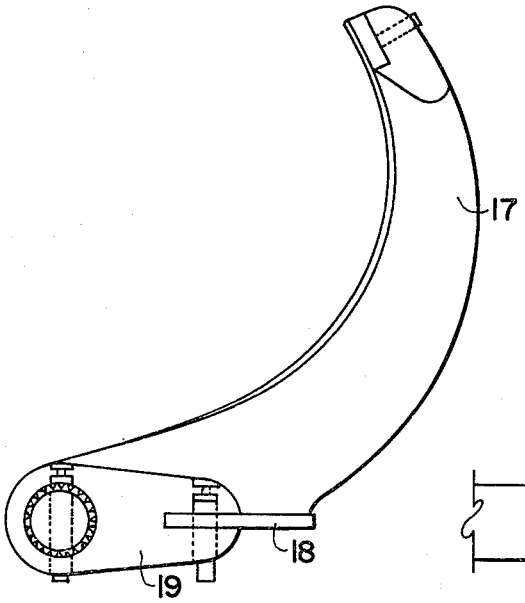
FIG. 2 PRIOR ART
FIG. 2 is an elevation view of a typical prior art bark tool.
Figure 4:
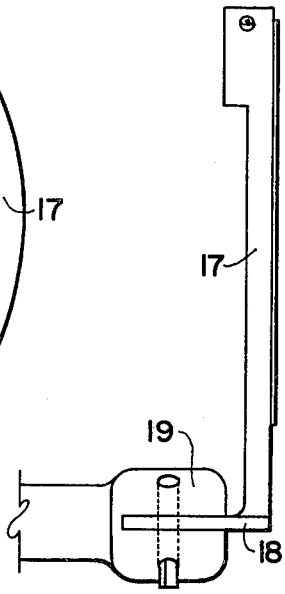
FIG. 4 PRIOR ART
FIG. 4 is a side elevation view of a typical prior art bark tool.
Figure 3:
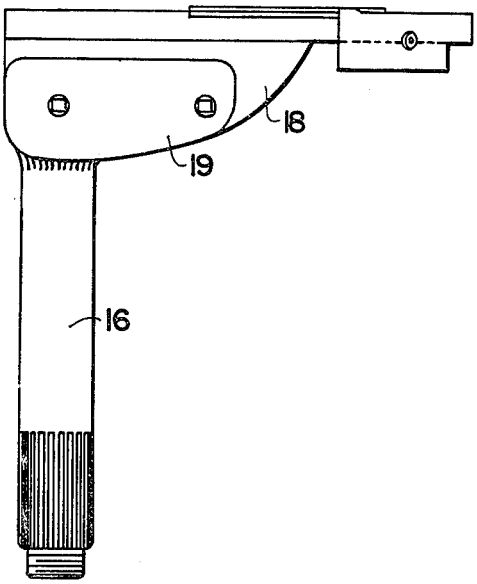
FIG. 3 PRIOR ART
FIG. 3 is a plan view of a typical prior art bark tool.

A conventional bark tool known in the prior art is shown by FIGS. 2, 3, and 4. A shaft 16 connects the bark tool 17 to the barking machine rotor. The tool 17 connects to a thin plate 18, which in turn is locked to jaws means 19 integral with the shaft. As previously described, this plate 18 and the area of the tool connected to the plate, are very susceptible of impact damage. Some tools in the prior art appear to be of nearly full width near or at the shaft; but the shaft either goes through the tool blade or connects to the shaft with a thin bracket. In either case, the forces are transmitted through connections with reduced effective structural capacity. By invention in contrast, has outlasted all other tools I have seen by twenty to fifty times the useful life of the prior art tools.

Figure 5:
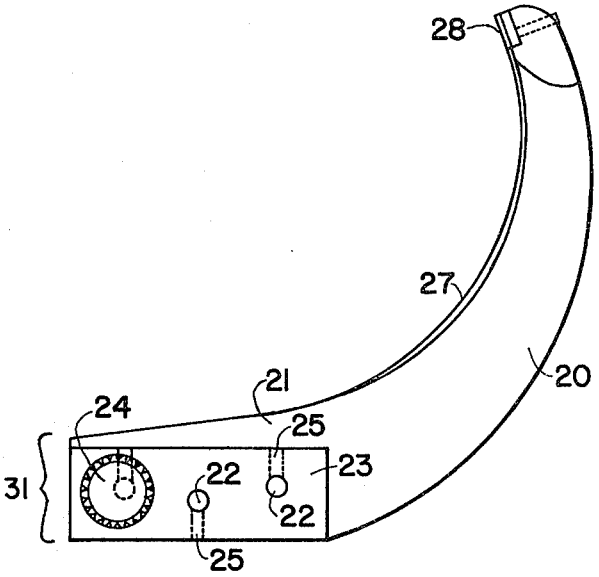
FIG. 5 is an elevation view of the improved bark tool.
Figure 7:
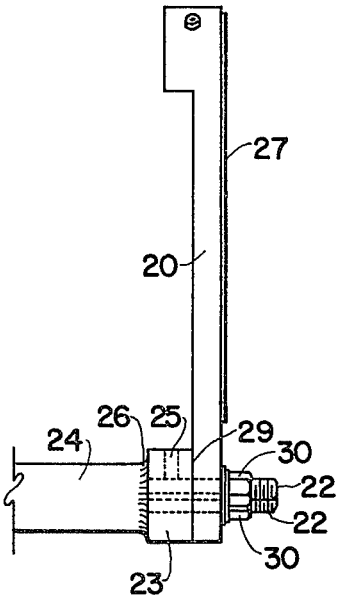
FIG. 7 is a side elevation view of the improved bark tool.
Figure 6:
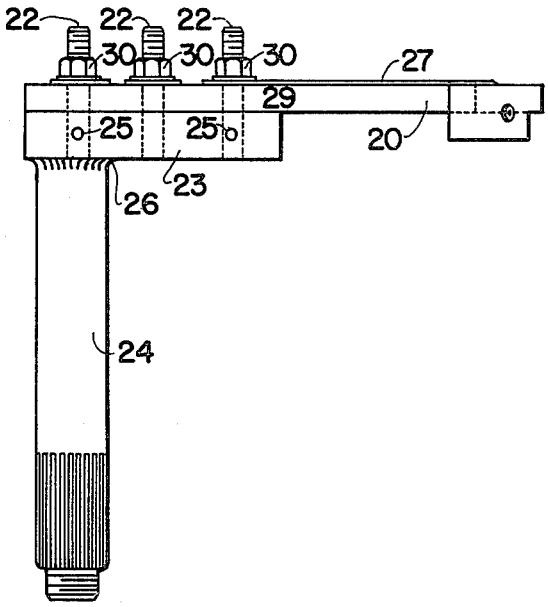
FIG. 6 is a plan view of the improved bark tool.

FIGS. 5, 6, and 7 show the tool as we have improved it. The bark tool 20 in the region marked 21 has very little attenuation in depth, thus adequately transmitting moment in the plane of the tool face and perpendicular to the face (in the direction of the shaft). That moment is transferred by shear reaction against the studs 22 through the shaft foot 23 to the shaft 24. Socket screws 25 fix the studs to the shaft foot. The shaft is preferably welded to the shaft foot by weld 26. Note that the bark tool 20 has a dimension 31 at its connecting end at least as great as the shaft foot width even at its narrowest point in the region of the connection. The bark tool in plan represents about one-quarter circle and generally crescent shaped.

The bark tool must be removable in order to allow maintenance of the edge 27 and tip 28. This is why the connection at the shaft foot is necessary in any tool.

Hence the obvious structural means for strengthening the bark tool have been unavailable. However, under our invention the strength is continuous and the tool is serviceable as afforded by the stud connections. Moment or torque transmission to a substantial degree is available by a friction interface 29 between the tool and the shaft foot when the stud fasteners 30 are tightened.

The bark tool and connecting parts are preferably made as described above, generally using $\frac{3}{4}$ inch rigid ferrous plate or alloy for the tool itself, and studs of the same nominal diameter as the plate thickness. The shaft foot should preferably be $1\frac{2}{3}$ times the plate thickness. A weld capable of developing the structural strength of the tool should connect the shaft to the foot. Bearing and lock washers should be used on the studs.

What we claim is:

1. Apparatus for removal of bark from logs, comprising: a debarker rotor; at least one shaft attached to said rotor and mounted for rotation about the longitudinal axis of said shaft; a bark tool attached to said shaft, said bark tool having a connecting end portion and a tip portion at opposite ends thereof, said connecting end portion being located adjacent said shaft and being not substantially narrower than the greatest depth of the bark tool; said tip portion having means for debarking a log and being located at the outer end of said bark tool for the purpose of making contact with bark to be removed from a log; said bark tool being in the form of a crescent shaped plate of rigid metal, approximately one-quarter circle in relative configuration; said debarker rotor having moment inducing means for applying force through said shaft to the tip portion of said bark tool; said bark tool having a structural shape with moment resisting capacity increasing substantially linearly from the tip end to the connecting end of said bark tool, wherein structural capacity in resisting moment induced stresses is defined by the formula $$\sigma=(M/S)$$

where $\sigma$ is stress, M is the moment and S is the section modulus, which for rectangular section is determined by the formula $$S=(bd^2/6)$$

where b is the thickness of the member transverse to the plane of bending and d is the depth of the member in the plane of bending; said shaft having a shaft foot production connected thereto, said shaft foot portion being located adjacent the connecting end of said bark tool, said connecting end being connected to said shaft foot by at least one stud connector whose shear reaction in the plane of the bark tool provides a moment resisting capacity equal to or greater than that of the connecting end of said bark tool, said shaft foot being substantially thicker than the bark tool thickness and elongated in the direction of the bark tool, said stud connector being arranged along the elongated portion of the shaft foot and fixed therein, said shaft foot being connected to said shaft by connecting means having sufficient, moment resisting capacity to transmit the moment from the debarker rotor to the bark tool.

* * * * *